US005857897A

United States Patent [19]

Krcek et al.

[11] Patent Number: 5,857,897

[45] Date of Patent: Jan. 12, 1999

[54] METHOD FOR MACHINING AN "O" RING RETENTION GROOVE INTO A CURVED SURFACE

[75] Inventors: Glenn Mark Krcek, Sterling Heights; Bruce Steven Shimanovski, Southfield; Sanjay Mahasukhlal Shah, Rochester Hills; George Thomas Winterhalter, Sr., Berkley, all of Mich.

[73] Assignee: General Motors Corporation, Detroit, Mich.

[21] Appl. No.: 935,938

[22] Filed: Sep. 23, 1997

[51] Int. Cl.[6] ..... B24B 5/16

[52] U.S. Cl. ..... 451/51; 451/28

[58] Field of Search ..... 451/28, 52, 51, 451/61, 431, 441; 29/156.5 R; 409/132, 84, 131, 199, 143

[56] References Cited

U.S. PATENT DOCUMENTS

| | | | |
|---|---|---|---|
| 3,370,508 | 2/1968 | Iaia | 90/11 |
| 3,961,404 | 6/1976 | Goloff et al. . | |
| 4,534,096 | 8/1985 | Garcia, Jr. et al. | 29/157.1 R |
| 4,778,314 | 10/1988 | Borys . | |
| 4,786,219 | 11/1988 | Oberlin et al. . | |
| 5,123,790 | 6/1992 | King | 409/132 |
| 5,398,533 | 3/1995 | Shimanovski et al. . | |
| 5,642,970 | 7/1997 | Yamaguchi et al. | 409/132 |
| 5,779,406 | 7/1998 | Astor | 409/132 |

*Primary Examiner*—Robert A. Rose
*Assistant Examiner*—Dung Van Nguyen
*Attorney, Agent, or Firm*—Patrick M. Griffin

[57] ABSTRACT

A method for cutting an "O" ring retention groove around the cutting edge of a hydropiercing die button. A groove machining tool is given a convex curved end surface the radius of which is slightly less than or, at most, substantially equal to the tightest concave radius that the end surface will have to sweep through as the groove is cut. Consequently, an accurate, slightly curved groove bottom surface is created for the "O" ring, while the machining tool will not bind as it moves through the tightest concave portion of the cutting path.

3 Claims, 5 Drawing Sheets

METHOD FOR MACHINING AN "O" RING RETENTION GROOVE INTO A CURVED SURFACE

TECHNICAL FIELD

This invention relates to a groove machining method in general, and specifically to a method for machining an "O" ring retention groove into a curved seal surface.

BACKGROUND OF THE INVENTION

Hydroforming, a process in which single piece, generally cylindrical steel blanks are expanded within a die cavity under great internal pressure to produce non cylindrical frame rails and the like, is finding greater and greater production use. A recent development which has greatly increased the utility of the process is so called hydropiercing, in which holes and slots can be cut through the surfaces of the pressure formed part right in the die, so as to avoid the necessity of later hole cutting steps. An example of hydropiercing can be seen in co assigned U.S. Pat. No. 5,0398,533 issued Mar. 21, 1995 to Shimanovski et al., where a flat surface on a hydroformed part is pierced by allowing the highly pressurized internal fluid to blow out through a sharp edged die button, removing a slug of metal as it escapes to leave behind a hole shaped like the die button edge. It is necessary that the perimeter of the cutting edge of the die button be surrounded by an "O" ring, which is inset into a retention groove. The "O" ring seal is firmly pressed into the part surface, surrounding the area to be cut through. The "O" ring acts as a face seal to prevent the escape of pressurized fluid as the hole is cut. Production of the die button itself, including the machining of the "O" ring retention groove, is a simple process when the part surface surrounding the hole to be cut is flat. In that case, the die button surface and groove are also correspondingly flat. When the hole is to be cut through a non flat, trough like surface, manufacture of the die button is more difficult. While it is relatively simple to machine the basic surface of the die button to match the part surface, there is no known way to easily machine the "O" ring retention groove down into that complex, non flat surface, especially where the groove must pass through concave curved transition areas or "valleys". The machining process is complicated by the fact that the ideal groove cross section should have undercut shoulders on each side so as to retain the round cross sectioned "O" ring in the groove with a "snap" fit around the sides of the "O" ring.

One known U.S. Pat. 4,786,219 issued Nov. 22, 1988 to Oberlin et al., does disclose a method for machining a continuous groove into the outer surface of an elliptical tube. Such an exterior surface is everywhere convex, however, with no concave transition areas. A flat bottomed machining tool is disclosed, which is moved around the cutting path, and maintained at both a constant cutting depth relative to the surface and at substantially a perpendicular orientation relative to the surrounding surface. Those tool conditions would be both givens for any such machining process, of course. The primary focus of the patent is maintaining the tool at a constant cutting depth. However, the flat bottomed tool disclosed would simply not work if used in a curved surface like that disclosed in the subject invention, as it would interfere or bind drag when moved through the concave, sharply radiused transition portions of the cutting path.

SUMMARY OF THE INVENTION

The invention provides a method and tool which can successfully cut a circumferentially complete groove of the desired cross sectional shape into a complex, non flat seal surface that does have such concave transition areas.

In the preferred embodiment disclosed, a desired retention groove cutting path is first established, which is a path that completely surrounds the perimeter of the die button's cutting edge. The smallest radius of any concave transition portion along that cutting path is determined, as well. The desired cross section for the groove is established, which has concave, undercut sides or shoulders that are spaced apart by less than the diameter of the round cross section of the annular "O" ring. Therefore, the "O" ring can be resiliently "snapped" into the groove and retained therein. The desired groove cross section also has a smooth bottom surface, against which the "O" ring will be held by the snap shoulders, and against which the undersurface of the "O" ring will be compressed when the upper surface is pressed against the outer surface of the part to be hydroformed. While the groove bottom surface need not be flat in cross section, and is not as disclosed, it should be smooth and continuous at all points, including the areas where it passes through one of the concave transitions of the cutting path.

A rotatable machining tool is provided, which spins about its center axis, and which has a machining head at the end which is generally bulbous or knob shaped in appearance. The cross section of the machining head, taken in any plane through the tool rotation axis, is constant and convex. In general, the constant, convex cross section of the machining head is made to match and ultimately produce the concave cross section desired of the "O" ring retention groove. Specifically, the convex sides of the machining head's cross section match the retention shoulders desired for the "O" ring groove. Also, the machining head end surface, is convex and curved, with a radius of curvature that is deliberately made equal to or slightly less than the smallest concave radius of curvature in the cutting path. A plunge point at some convenient single point along the cutting path is established where the machining head can be both inserted into the cutting path to a cutting depth, and later withdrawn from the groove produced.

The rotating tool is then inserted into the surface to the required depth, and moved completely around the cutting path, while always being maintained substantially perpendicular to the adjacent surface. As the machining head moves through the tightest concave transition portion in the cutting path, the deliberate radius limitation on the machining head end surface assures that the machining head will sweep through without binding or gouging at the bottom surface of the groove. Finally, the tool is withdrawn at the same, single point.

DESCRIPTION OF THE PREFERRED EMBODIMENT

Figure 1:
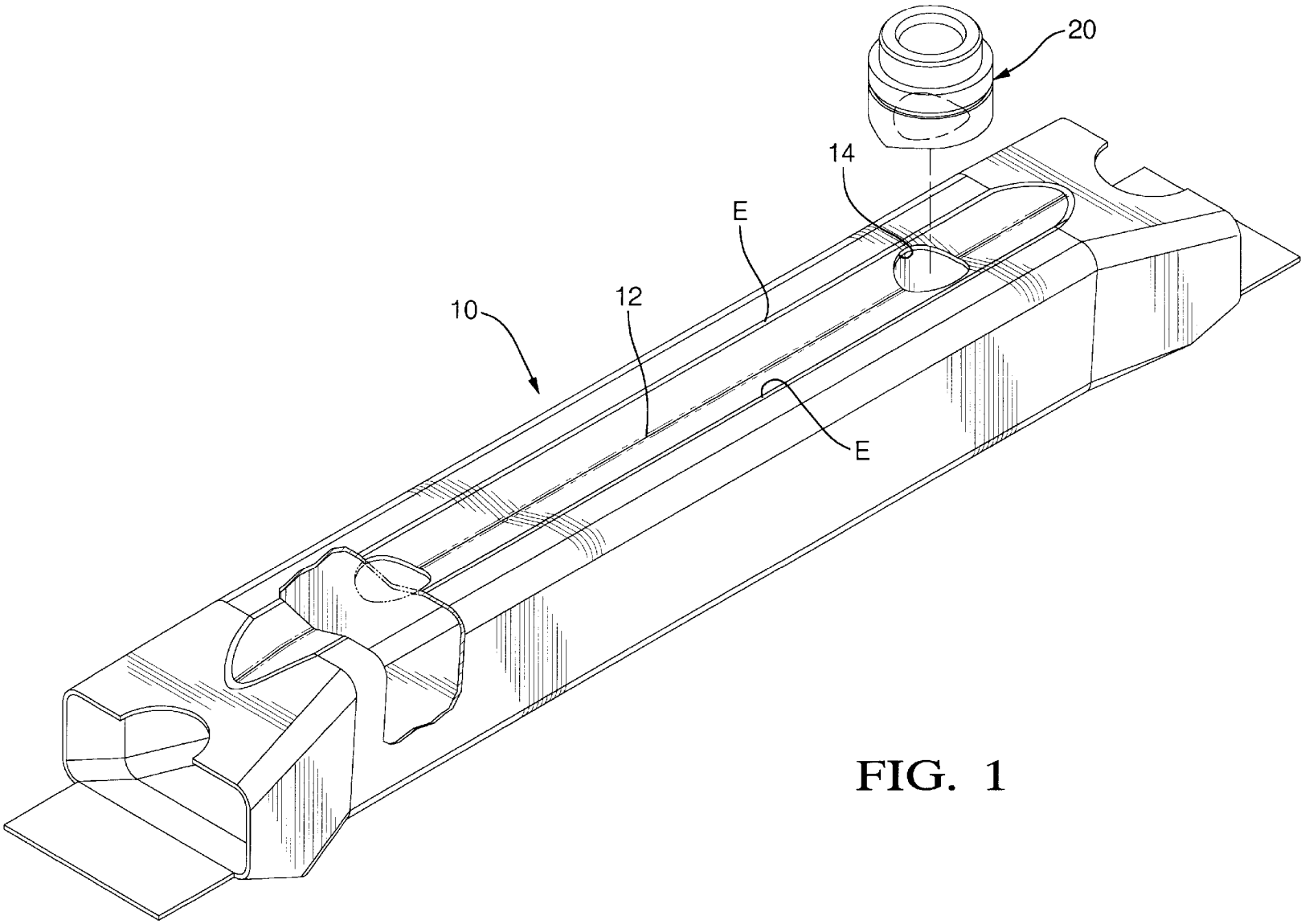
FIG. 1 is a perspective view of a hydroformed part incorporating a trough like surface through which a hole is to be hydropierced, and showing a die button made according to the invention aligned with a hole to be pierced.

Referring first to FIG. 1, a hydroformed part, in this case, a hollow steel beam of generally rectangular cross section, is indicated generally at 10. Beam 10 is distinctive in that at least one side thereof contains a lengthwise, trough like indentation at 12, through which a generally elliptical hole 14 is to be pierced. The outer surface of beam 10 surrounding hole 14 transitions from flat to sloped across a pair of convex, parallel corner edges indicated at E. The edges E are not acutely pointed, of course, but have a fairly sharp radius of curvature, about 0.390 inches as disclosed. This is a transition that occurs at four points while moving a full 360 degrees around hole 14. Of course, the beam surface is concave at the very bottom of the indentation 12, also. The complex, non flat shape of beam 10 surrounding hole 14 is significant to the apparatus that produces the hole 14, and to the method by which that apparatus is manufactured, which is the subject matter of the instant invention.

Figure 2:
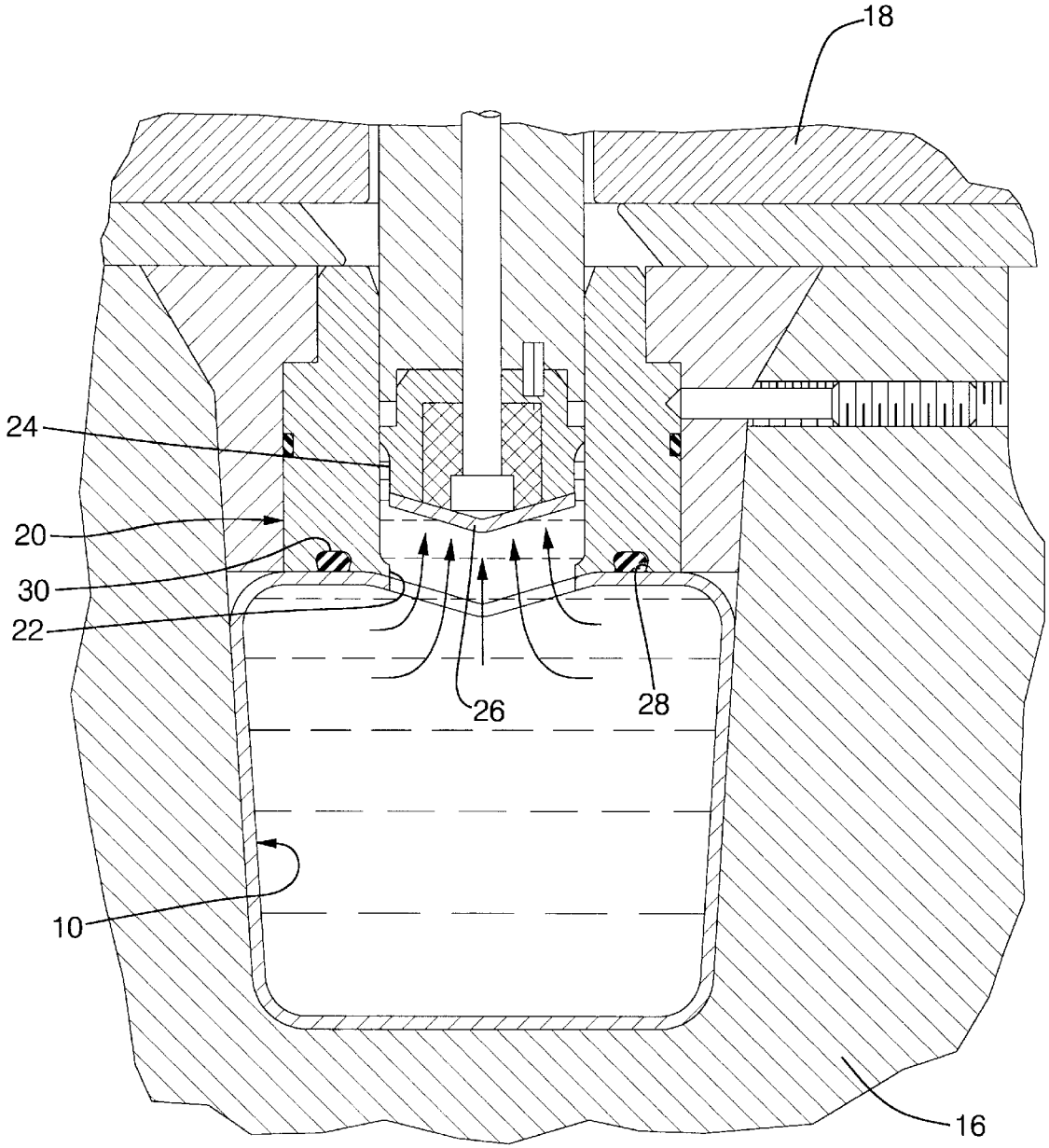
FIG. 2 is a cross section of the part shown in FIG. 1, in a hydroforming die incorporating a piercing apparatus made according to the method of the invention.

Referring next to FIG. 2, a single hydroforming and piercing apparatus performs both the basic beam shape forming function and the piercing of hole 14. A pair of heavy, solid hydroforming dies 16 and 18 clamp around a generally cylindrical tube blank, not illustrated in its initial shape, which is sealed at the ends and highly internally pressurized to take on the final shape shown. The lower die 16 supports the three flat sides of beam 10, while the upper die 18 supports and forms the other side, including the indentation 12 where hole 14 is to be ultimately cut. Hole 14 is formed as a final step, while the interior of beam 10 is still highly pressurized. A die button, indicated generally at 20, is mounted flush to the inner surface of upper die 18, and held close against the outer surface of beam 10. Die button 20 is generally hollow or sleeve shaped, formed with a sharp cutting edge 22, the perimeter of which matches the size and shape of the hole 14 to be cut. The interior of die button 20 includes a backing plunger 24, which is initially held solidly flush to the cutting edge 22, but which can be backed off once the basic shape of beam 10 has been formed. Initially, the flush backing plunger 24 rigidly supports the beam wall material interior to the die button cutting edge 22, just as the inner surface of the upper die 18 itself would. When the plunger 24 is backed up, the beam wall material is no longer supported inside of the cutting edge 22, and the still highly pressurized fluid inside of beam 10 blows out a slug of material 26 through the cutting edge 22, leaving behind the desired shape hole 14. The beam 10 is then depressurized, drained, slug 26 removed, and the forming process is complete. In order to prevent the loss of pressurized fluid past the cutting edge 22 as the slug 26 is blown through, an "O" ring type compressible face seal 28 is inset into the surface of die button 20, surrounding the perimeter of cutting edge 22. The "O" ring seal 28 is circular in cross section, and its upper surface is compressed and flattened slightly against the outer surface of beam 10, surrounding the hole 14. Other seals surrounding plunger 24 prevent the loss of fluid through the center of die button 20. It is critical that seal 28 be accurately inset into the surface of die button 20 in order to be continuously compressed against the surface of beam 10. The method by which seal 28 is retained to the die button 20 is described next.

Figure 3:
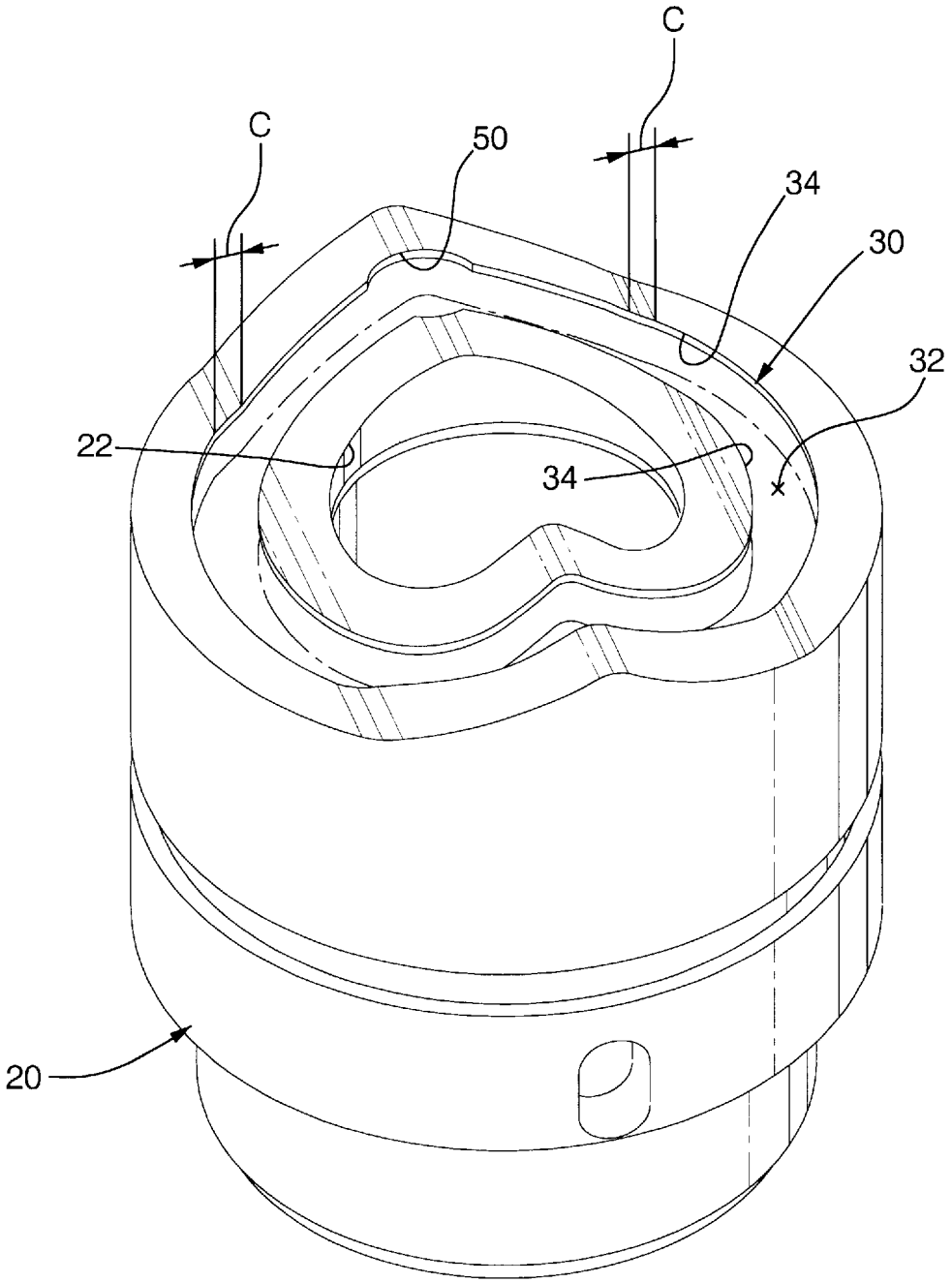
FIG. 3 is a perspective view of the surface of the die button cut with the "O" ring retention groove.
Figure 5:
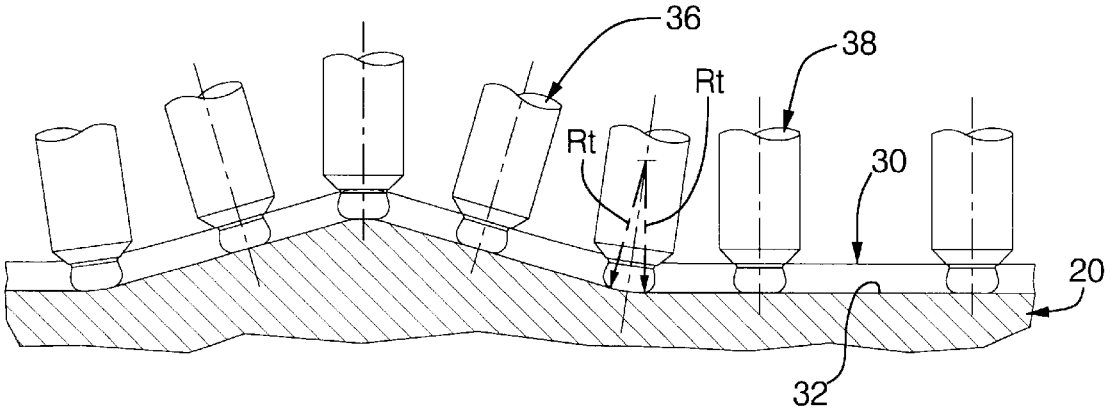
FIG. 5 is a schematic view showing a portion of the cutting path through which the groove cutting tool would move "rolled out" or flat, indicating the radius of a concave transition portion of the cutting path, as well as the motion of one of the machining tools used to create the groove.
Figure 6:
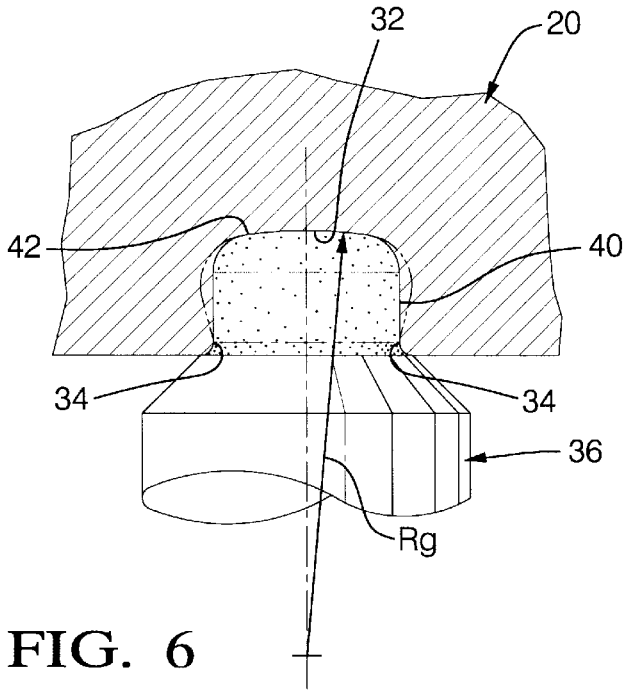
FIG. 6 is a side view of a machining tool used to "rough out" the basic shape of the retention groove, shown in a cross section of the retention groove.
Figure 7:
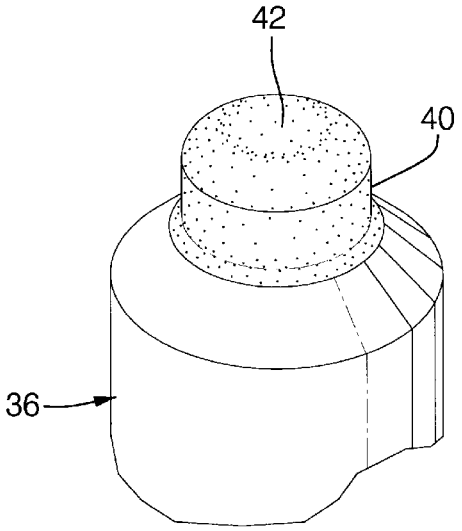
FIG. 7 is a perspective view of the roughing tool.

Referring next to FIGS. 3 and 5, the basic challenge involved in successfully and accurately retaining an "O" ring seal 28 surrounding the perimeter of the die button cutting edge 22 can be seen. The non flat surface of die button 20 surrounding the edge 22 matches, but is the converse of, the outer surface of beam 10, described in detail below. Therefore, the surface of die button 20 will be concave where the beam surface is convex, convex where it is concave, but flat where it is flat. Consequently, the surface of die button 20 must also make four sharply curved concave transitions from flat to sloped at the corresponding four convex points where it crosses the beam edges E. At two points, the perimeter surface would be convex, corresponding to the concave bottom of the indentation 12. The four concave transition areas are most relevant to the subject invention, and are difficult to distinguish visually, but their general location is noted at the four bracketed areas marked "C" in FIG. 3. FIG. 5 is a schematic view of a section of a 360 degree perimeter cutting path around cutting edge 22 flattened or "rolled out" to indicate one such concave portion and its radius of curvature, designated Rt. The smallest such concave radius of curvature Rt along the cutting path would match the transition areas C on beam 10, which in turn match the transition at the edges E on the beam surface, and represents a given, fixed condition in any given case. A retention groove, indicated generally at 30, must be cut into the surface of die button 20 to retain the "O" ring 28, along a 360 degree cutting path that runs through all of the same transition areas. The two convex areas of the cutting path present no difficulty, and could be cut by conventional groove cutting techniques as described above. At the four concave transition portions of the cutting path, however, known techniques would not work.

Figure 4:
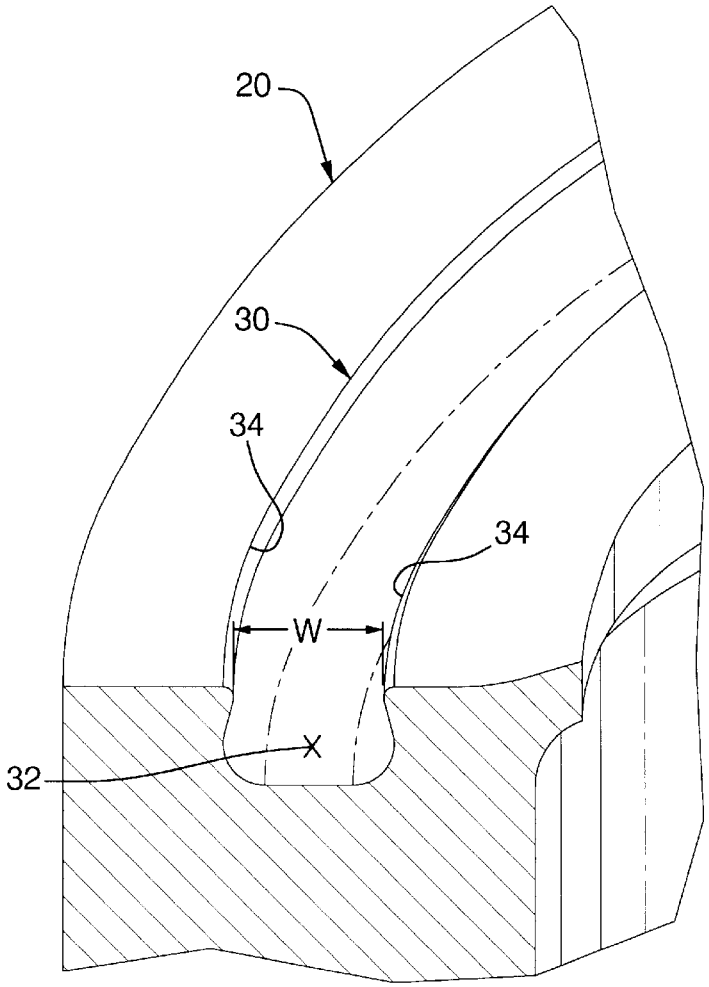
FIG. 4 is a section through a part of the "O" ring retention groove of FIG. 3 shown in cross section.

Referring next to FIG. 4, other significant details of the cross sectional shape of retention groove 30 are illustrated in relationship to the circular cross section of the "O" ring 28 itself. In general, such a groove 30 would be as wide as the diameter of the circular cross section of "O" ring 28, but not significantly wider, and slightly less deep, so as to leave the upper surface exposed while holding the sides of "O" ring 28 closely. As such, the circular cross section of the retained "O" ring 28 will be flattened out slightly to a generally elliptical shape as it is compressed between the outer surface of beam 10 and the retention groove bottom surface 32. Groove 30, in order to seal successfully, must provide a bottom surface 32 suitable to compress smoothly and continuously against the flattened bottom surface of the "O" ring 28. A suitable groove bottom surface 32, therefore, will be either flat or have a slight radius of curvature that is greater than, but not less than, the radius of the cross section of "O" ring 28. In addition, it is preferable that the groove 30 do more than simply provide a suitable seal compression bottom surface 32. Ideally, it would also serve to solidly retain ring 28 in place, and this is done here by a pair of retention shoulders 34, spaced apart by a width W somewhat less than the diameter of the cross section of "O" ring 28. The shoulders 34 act as a constriction in the groove 30 to hold the "O" ring 28 down against the bottom surface 32 by a slight "snap" fit. Details of the tooling and method that produce groove 30 are described next.

Figure 8:
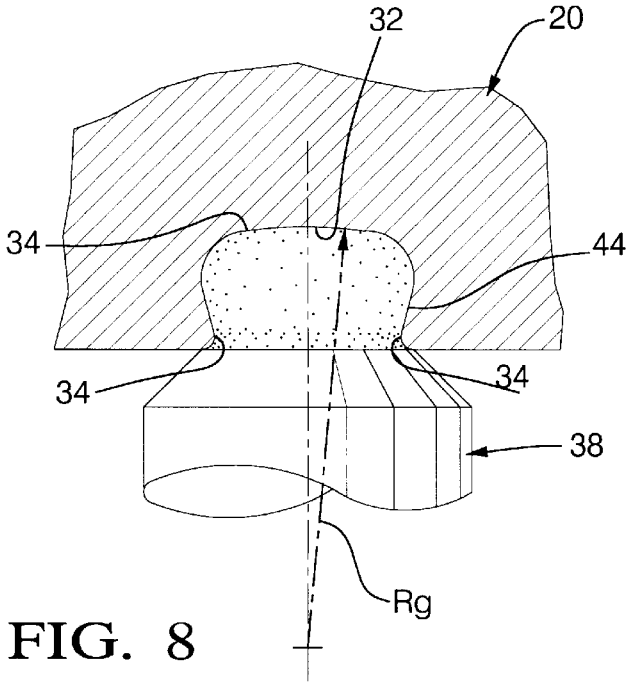
FIG. 8 side view of the machining tool used to finalize the shape of the retention groove, also shown in a cross section of the retention groove.
Figure 9:
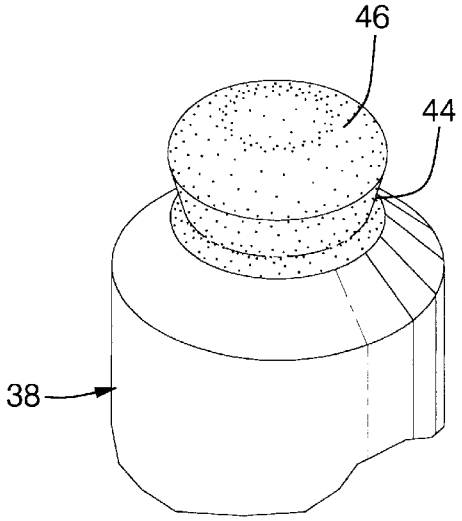
FIG. 9 is a perspective view of the final machining tool.

Referring next to FIGS. 6 through 9, groove 30 is ground or cut by a series of two tools, a roughing tool indicated generally at 36, which cuts the basic groove 30, and a finishing tool indicated generally at 38. Roughing tool 36 has a generally cylindrical machining head 40 that spins about its central axis, with a cross section that is constant as taken in any plane containing the center axis. Specifically, that cross section is defined by a constant width substantially equal to the groove least width W defined above and, most importantly, by a convex, curved end surface 42 having a radius of curvature Rg at most equal to, or just slightly less than, the least concave radius of curvature Rt of the cutting path concave curved portions C as defined above. The purpose for this relative radius limitation is described below. The finishing tool 38 has a machining head 44 that is generally bulbous, also with a cross section that is identical in any plane through its center axis. That cross section, as best seen in FIG. 8, has the same curved end surface 46 with the same radius Rg as the roughing tool 36, and so has the same radius limitation relative to the least radius Rt of the cutting path concave curved portion C. The cross section differs from the roughing tool machining head 40 by having convex sides 48 that match the concave retention shoulders desired in the finished groove 30. The tools 36 and 38 operate as described below.

Referring next to FIGS. 3 and 5, groove 30 is cut initially by first establishing a suitable cutting path as defined above, that is, an annular area (whether circular, elliptical or whatever shape) that runs at substantially a constant radius around the center point of the hole 14, for 360 degrees. Once established, the smallest radius of curvature of any concave transition portion along the path is determined, which was already noted above. Then, a single entry/exit or "plunge" point 50 is established on the cutting path, which is a single point where a tool can be both inserted and withdrawn from the cut. Conveniently, as seen in FIG. 3, that common point 50 is established at one of the two high, convex points along the path, which correspond to the low points of the beam indentation 12. Then, the roughing tool 36 is pushed into the surface of die button 20, at the point 50, and run completely around the cutting path as it spins about its center axis, shown by the dotted line. The center axis is maintained substantially perpendicular to the surface of die button 20 adjacent to the cutting path. FIG. 5 shows the orientation of the finishing tool 38 at a plurality of points. The roughing tool 36 is run through the same cutting path first. It establishes the basic width, depth and, most importantly, the basic bottom surface 32 of groove 30, all but the retention shoulders 34 (whose ultimate location is shown in dotted lines in FIG. 6). By limiting the curved machining head end surface 42 to the radius as defined above, the machining head 40 will sweep through the four concave curved portions C along the cutting path without binding or interference, producing a constant, smooth groove cross section. Stated differently, as the end surface 42 moves through a constricted area C, the axis of the tool 36 can effectively swing about the end surface 42 without catching in the curved area C, which is everywhere as large or slightly larger in radius than end surface 42. When the roughing tool 36 has been withdrawn from point 50, the finishing tool 38 is run around the same path in the rough cut groove, as shown in FIG. 5. Its end surface 46 maintains the same slightly curved groove bottom surface 32, finishing it a bit more finely, but holding the same shape. Its sides 48 cut the retention shoulders 34, and finishing groove 30. With both tools 36 and 38, the curved end surfaces 42 and 46 are designed not so much to match or produce a particular bottom surface 32 desired for the "O" ring groove 30, so much as they are designed to successfully cut a groove 30 without scuffing or binding as they move through the constricted areas C along the cutting path. The curved groove bottom surface 32 that is produced in that process also happens to be smooth, circumferentially continuous, and of a proper curvature (the same curvature as the end surfaces of the tools 36 and 38) to properly compress the undersurface of the circular cross sectioned "O" ring 28. The process can be conceptualized in reverse, however, as one of first establishing a groove cross section which, in addition to being the proper width and depth to receive and hold the circular cross section of the "O" ring 28, also has a slightly curved bottom surface 32 with the same "equal to or less than" radius limitation relative to the cutting path portion C. So conceptualized, the next step is to match the machining tool head cross section to that desired groove cross section, and then machine the groove in the same way. However conceptualized, the end result of the process is the same. Finally, "O" ring 28 can be snapped into the completed groove 30.

Other beams to be formed could well have very different surfaces surrounding a hole to be pierced therethrough, but the basic technique disclosed for establishing the cutting path and for shaping and using the groove machining or cutting tools will work. Even if the surface through which the cutting path runs is everywhere convex, the basic process will still work, although it was developed to handle concave transition areas along the path, which were not amenable to existing techniques. It is also theoretically possible that just the single finishing tool 38 could be used to cut the final shape of groove 30 in one pass. However, the tool might have to be moved more slowly, and tool wear would be higher. Conversely, it would be possible to machine a very basic groove without the retention shoulders 34, and with just the curved bottom surface 32 as defined. Such a groove could be suitable where the deviation from a flat surface was not great, so that a snap fit retention of the seal into the groove was not so necessary. The single entry exit point 50 is preferable, so as not to disturb the otherwise constant cross section of groove 30 more than needed. However, even if the tools were withdrawn at other points, the bottom surface 32, which is what provides the seal, would still be continuous.

What is claimed is:

1. A method for machining a retention groove for an "O" ring type seal in a non flat surface having at least one concave curved portion, comprising the steps of:

establishing a circumferentially complete cutting path for said groove in said non flat surface;

determining the smallest radius of curvature of said concave curved portion along said cutting path;

providing a groove machining tool rotatable about a center axis and having a machining head with a constant cross section, taken through said axis, and having a curved end surface, the radius of which is substantially equal to or slightly less than said smallest concave radius of curvature;

rotating said machining tool about its axis while inserting said machining head into said non flat surface to a depth sufficient to cut said groove;

moving said machining tool around said cutting path while maintaining said tool axis substantially perpendicular to said non flat surface; and, withdrawing said machining tool;

whereby, said machining head will sweep through said smallest concave radius of curvature along said cutting path without interference while machining a groove bottom surface with said tool machining head curved end surface suitable for compression against said "O" ring type seal.

2. A method for machining a retention groove for an "O" ring type seal in a non flat surface having at least one concave curved portion, comprising the steps of:

establishing a circumferentially complete cutting path for said groove in said non flat surface;

determining the smallest radius of curvature of said concave curved portion along said cutting path;

providing a groove machining tool rotatable about a center axis and having a machining head with a constant cross section, taken through said axis, and having a curved end surface, the radius of which is substantially equal to or slightly less than said smallest concave radius of curvature;

establishing a single entry and exit point for said machining head on said cutting path;

rotating said machining tool about its axis while inserting said machining head into said non flat surface at said single point to a depth sufficient to cut said groove;

moving said machining tool around said cutting path while maintaining said tool axis substantially perpendicular to said non flat surface; and, withdrawing said machining tool at said single point;

whereby, said machining head will sweep through said smallest concave radius of curvature along said cutting path without interference while machining a groove bottom surface with said tool machining head curved end surface suitable for compression against said "O" ring type seal.

3. A method for machining an "O" ring retention groove in a non flat surface having at least one concave curved portion, comprising the steps of:

establishing a circumferentially complete cutting path for said groove in said non flat surface;

determining the smallest radius of curvature of said concave curved portion along said cutting path;

establishing a cross sectional shape for said retention groove having a width and depth sufficient to hold said "O" ring and a continuous curved bottom surface with a radius of curvature substantially equal to or less than said smallest radius of curvature;

providing a groove machining tool rotatable about a center axis and having a machining head with a constant cross section, taken through said axis, that matches said groove cross section;

establishing a single entry and exit point for said machining head on said cutting path;

rotating said machining tool about its axis while inserting said machining head into said non flat surface at said single point to a depth sufficient to cut said groove;

moving said machining tool around said cutting while maintaining said tool axis substantially perpendicular to said non flat surface; and, withdrawing said machining tool machining head at said single point;

whereby, said machining head will move through said smallest concave radius of curvature along said cutting path without interference while cutting said established groove cross section.

* * * * *